US005268090A

United States Patent [19]

Lomas et al.

[11] Patent Number: 5,268,090

[45] Date of Patent: Dec. 7, 1993

[54] FCC PROCESS FOR REDUCING SOX USING $H_2S$ FREE LIFT GAS

[75] Inventors: David A. Lomas, Barrington; Harold U. Hammershaimb, Western Springs; Robert M. Smith, Itasca, all of Ill.

[73] Assignee: UOP, Des Plaines, Ill.

[21] Appl. No.: 851,608

[22] Filed: Mar. 16, 1992

[51] Int. Cl.[5] ..... C10G 11/18

[52] U.S. Cl. ..... 208/153; 208/161; 208/164; 208/152; 208/157; 208/163

[58] Field of Search ..... 208/161, 153

[56] References Cited

U.S. PATENT DOCUMENTS

| | | | |
|---|---|---|---|
| 2,913,402 | 11/1959 | Turpin, Jr. | 208/161 |
| 3,193,486 | 7/1965 | Payne | 208/161 |
| 3,305,475 | 2/1967 | Waldby et al. | 208/161 |
| 4,240,899 | 12/1980 | Gladrow et al. | 208/120 |
| 4,331,533 | 5/1982 | Dean et al. | 208/161 |
| 4,332,674 | 6/1982 | Dean et al. | 208/161 |
| 4,479,870 | 10/1984 | Hammershaimb et al. | 208/164 |
| 4,988,430 | 1/1991 | Sechrist et al. | 208/161 |
| 5,141,625 | 8/1992 | Lomas | 208/161 |

*Primary Examiner*—Helane Myers

*Attorney, Agent, or Firm*—Thomas K. McBride; John G. Tolomei

[57] ABSTRACT

This invention provides a method of reducing the sulfur oxide emissions from the regenerator of an FCC process that cracks a sulfur containing feedstream. The sulfur oxide emissions are reduced by using an essentially sulfur free lift gas stream to shift the sulfur concentration equilibrium between the product stream from the reaction zone and the flue gas stream from the regeneration zone. Sulfur compounds present in the FCC feed leave the reaction zone as volatile sulfurous gases in the product vapor stream or as adsorbed sulfur compounds on the catalyst. Sulfurous gas in the product vapors is mainly $H_2S$. By lowering the concentration of $H_2S$ that enters the riser with the lift gas the equilibrium reaction of sulfur with hydrogen in the riser is favorably shifted to increase the production of $H_2S$ and decrease the lay down of sulfur compounds in the coke that forms on the catalyst. As a result less sulfur enters the regeneration zone with the spent catalyst and fewer sulfur oxides are formed during regeneration.

13 Claims, No Drawings

FCC PROCESS FOR REDUCING SOX USING $H_2S$ FREE LIFT GAS

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the reduction of sulfur oxide emissions from the flue gas of an FCC process.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalyst function, acts as a vehicle for the transfer of heat from zone to zone. Catalyst exiting the reaction zone is spoken of as being spent, i.e., partially deactivated by the deposition of coke upon the catalyst.

One improvement to FCC units is the practice of riser cracking. In riser cracking, regenerated catalyst and starting materials enter a pipe reactor and are transported upward by the expansion of the gases that result from the vaporization of the hydrocarbons, and other fluidizing mediums if present upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light, saturated hydrocarbons are generally used.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a gas concentration section for further separation into additional product streams.

Almost all FCC feedstocks will contain some sulfur. This sulfur is typically in the form of organic sulfur compound. During cracking, contact of the feed with the cracking catalyst will convert the feed sulfur to hydrogen sulfide, carbon oxysulfide, normally liquid organic sulfur compounds and residual sulfur that is contained in the coke deposits that form on the catalyst. Although a substantial amount of he sulfur is removed with the vapor product stream from the reactor, a substantial amount of the feed sulfur passes with the catalyst into the regenerator. As coke is burned off the catalyst in the regeneration zone most of the sulfur present on the catalyst is converted to sulfur dioxide with a small amount being converted to sulfur trioxide.

The sulfur oxide containing gases are withdrawn from the regenerator with the regenerator flue gases.

An increasing awareness of the health and environmental problems caused by sulfur pollution has led to restrictions on the emissions of sulfur oxides into the atmosphere. Therefore economical methods of reducing sulfur emissions from FCC process units are in demand. One common method of reducing sulfur emissions is to recover sulfur oxides from the flue gas by means of wet gas scrubbing. The high temperature and relatively large volume of the flue gas complicates the direct removal of sulfur oxides and increases the cost of such removal methods. Sulfur oxide emissions from flue gas can also be reduced indirectly by feed treatment to lower the amount of feed sulfur or the use of acceptor or transfer function catalysts that inhibit the formation of sulfur oxides during the combustion of coke in the regenerator. However the removal of sulfur from the feed adds equipment and operational expense to the unit and the use of special catalysts can increase costs and affect the operation of the process.

INFORMATION DISCLOSURE

U.S. Pat. No. 4,479,870, issued to Hammershaimb et al. on Jun. 30, 1984, teaches the use of lift gas having a specific composition in a riser zone at a specific set of flowing conditions with the subsequent introduction of the hydrocarbon feed into the flowing catalyst and lift gas stream.

U.S. Pat. No. 4,240,899 issured to Gladrow et al. teaches the use of a catalyst having a sulfur transfer function to reduce the production of sulfur oxides in the regenerator. The method of this invention is used in the regeneration of coke that has sulfur compounds deposited therein when contacting a sulfur containing feedstream. The transfer function promotes the production of magnesium sulfate which is ultimately decomposed and hydrolyzed on the reactor side to produce hydrogen sulfide. Hydrogen sulfide is easily separated from the reactor vapor stream by amine scrubbing.

SUMMARY OF THE INVENTION

This invention provides a method of reducing the sulfur oxide emissions from the regenerator of an FCC process that cracks a sulfur containing feedstream. In this invention the sulfur oxide emissions are reduced by using an essentially sulfur free lift gas stream to shift the sulfur concentration equilibrium between the product stream from the reaction zone and the flue gas stream from the regeneration zone. Sulfur compounds present in the FCC feed leave the reaction zone as volatile sulfurous gases in the product vapor stream or as adsorbed sulfur compounds on the catalyst. Sulfurous gas in the product vapors is mainly $H_2S$. By lowering the concentration of $H_2S$ that enters the riser with the lift gas the reaction of sulfur with hydrogen in the riser is favorably shifted to increase the production of $H_2S$ and decrease the lay down of sulfur compounds in the coke that forms on the catalyst. As a result less sulfur enters the regeneration zone with the spent catalyst and fewer sulfur oxides are formed during regeneration. As a result this invention can reduce or eliminate the need for flue gas scrubbing or sulfur acceptor catalysts.

Accordingly in one embodiment, this invention is a fluidized catalytic cracking (FCC) process for treating an FCC feedstock wherein the feedstock contains sulfur compounds. The process includes the steps of contacting regenerated FCC catalyst with a lift gas having a total concentration of sulfur compounds of less than 50 ppm in the upstream portion of a riser conversion zone and passing the mixture of catalyst and lift gas to a downstream section of the riser and contacting the mixture with the feedstock to crack hydrocarbons in the feedstock, convert the sulfur compounds to $H_2S$, and deposit coke on the catalyst. The cracked hydrocarbons and $H_2S$ are separated from the catalyst and a cracked product stream comprising the cracked hydrocarbons and the $H_2S$ is recovered. The catalyst containing coke deposits is passed to a regeneration zone and contacted in the regeneration zone with an oxygen containing gas at an elevated temperature to regenerate the catalyst by the combustion of coke and to produce a flue gas containing the by products of the coke combustion. The regenerated catalyst particles are separated from the flue gas and passed to the riser conversion zone as the supply the regenerated catalyst.

Other embodiments and aspects of the present invention are provided in the following detailed description of the invention.

DESCRIPTION OF THE INVENTION

The catalyst which enters the riser and can be used in the process of this invention include those known to the art as fluidizing catalytic cracking catalysts. These compositions include amorphous clay type catalysts which have for the most part been replaced by high activity crystalline alumina silicate or zeolite containing catalysts. Zeolite catalysts are preferred over amorphous type catalysts because of thier higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, aluminum, or zirconium. These catalyst compositions may have a zeolite content of 30% or more.

Feeds suitable for processing by this invention, include conventional FCC feedstocks or higher boiling hydrocarbon feeds. In order to derive the benefit of this invention the feed will contain sulfur compounds in an amount equal to 0.1 to 2.5 wt. percent of the feed. Preferably the feed will contain over 1 wt. percent of sulfur compounds.

The most common of the conventional feedstocks is a vacuum gas oil which is typically a hydrocarbon material having a boiling range of from 650°-1025° F. and is prepared by vacuum fractionation of atmospheric residue. Such fractions are generally low in coke precursors and heavy metals which can deactivate the catalyst.

This invention is most likely to be useful for the processing of heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

Before contact with the feed the catalyst entering the riser is first contacting with a lift gas. The finely divided regenerated catalyst entering the bottom of the reactor riser leaves the regeneration zone at a high temperature usually in the range of 1200°-1400° F. Where the riser is arranged vertically, the bottom section will be the most upstream portion of the riser. In most cases, the riser will have a vertical arrangement, wherein lift gas and catalyst enter the bottom of the riser and converted feed and catalyst leave the top of the riser. Nevertheless, this invention can be applied to any configuration of riser including curved and inclined risers. The only limitation in the riser design is that it provide a substantially smooth flow path over its length.

Contact of the hot catalyst with the lift gas accelerates the catalyst up the riser in a uniform flow regime that will reduce backmixing at the point of feed addition. Reducing backmixing is important because it varies the residence time of hydrocarbons in the riser. Addition of the lift gas at a velocity of at least 3 feet per second is desirable to achieve a satisfactory acceleration of the catalyst. The lift gas used in this invention is more effective when it comprises $C_3$ and lower molecular weight hydrocarbons and particularly when it includes not more than 10 mol % of $C_3$ and heavier olefinic hydrocarbons. Low molecular weight hydrocarbons in the lift gas are believed to selectively passivate active metal contamination sites on the catalyst to reduce the hydrogen and coke production effects of these sites. Selectively passivating the sites associated with the metals on the catalyst leads to greater selectivity and lower coke and gas yield from a heavy hydrocarbon charge. Some steam may be included with the lift gas and, in addition to hydrocarbons, other reaction species may be present in the lift gas such as $H_2$, $H_2S$, $N_2$, CO, and/or $CO_2$. In accordance with this invention the amount of $H_2S$ present in the lift gas is minimized. To achieve maximum effect from the lift gas it is important that appropriate contact conditions are maintained in the lower portion of the riser. The residence time of the catalyst and lift gas mixture in the lift gas zone can vary from 0.1 to 10 seconds. A residence time of 0.5 seconds or more is preferred in the lift gas section of the riser, however, where such residence time would unduly lengthen the riser, shorter residence times for the lift gas and catalyst may be used. A weight ratio of catalyst to hydrocarbon in the lift gas of more than 80 is also preferred.

After the catalyst is accelerated by the lift gas, it enters a downstream portion of the riser which is generally referred to as the upper section. Feed may be injected into the riser nozzles as commonly practiced or using any device that will provide a good distribution of feed over the entire cross-section of the riser. Atomization of the feed, as it enters the riser, promotes good distribution of the feed. A variety of distributor nozzle and devices are known for atomizing feed as it is introduced into the riser. Such nozzles or injectors may use homogenizing liquids or gas which are combined with the feed to facilitate atomization and dispersion. Steam or other non-reactive gases may also be added with the feed, for purposes of establishing a desired superficial velocity up the riser. High superficial velocities that produce short residence times of five seconds or less are generally preferred. The superficial velocity must be relatively high in order to produce an average residence time for the hydrocarbons in the riser of less than 5 seconds. Shorter residence times permit the use of higher reaction temperatures and provide additional benefits as discussed below; thus where possible the feed has a residence time of 2 seconds or less. However in order to provide adequate time for the sulfur compounds to establish equilibrium, a residence time of at least 2 seconds is preferred.

The catalyst and feed mixture has an average temperature in a range of from 850°-1050° F. A combination of a short residence time and higher temperatures in the riser shifts the process towards primary reactions. These reactions favor the production of gasoline and tend to reduce the production of coke and light gases. Furthermore, a higher temperature raise gasoline octane. A short catalyst residence time within the riser is also important for maintaining the shift towards primary reactions and removing the hydrocarbons from the presence of the catalyst before secondary reactions that favor coke and light gas production have time to occur.

The high velocity stream of cataylst and hydrocarbons is then rapidly separated at the end of the riser. This can be accomplished by passing directly into a cyclonic separation system or the riser can be configured so as to abruptly change direction before this initial separation. The separated vapors begin their path toward the product recovery zone while the separated catalyst is directed toward the stripping zone.

Specific methods of transferring catalyst from a stripping section to a regeneration zone, regenerating the catalyst and returning catalyst to a reactor riser are well known to those skilled in the art and any such methods may be used in conjunction with a reaction section that uses a low $H_2S$ lift gas in accordance with this invention.

Product vapors are recovered from the reaction zone and enter the product recovery facilities. Normally liquid and gaseous products are separated in the product facility in ordinary fashion. Separation of the products from this invention poses no unusual requirements on the product recovery facilities since the reactor vapor stream contains no more $H_2S$ than would ordinarily be present in the reactor vapor stream.

There is no requirement that the $H_2S$ lift gas of this invention be obtained from any particular source. Suitable lift gas streams for this invention will have an $H_2S$ concentration of less than 50 ppm and an overall sulfur compound concentration of less than 55 ppm. Lift gas streams with an appropriate composition and sulfur concentration can be derived from lift gas streams that are found in the gas concentration section of the product facilities.

In a typical FCC arrangement, the product facilities include a main column for cooling the hydrocarbon vapor from the reactor and recovering a series of heavy cracked products which usually include bottoms material, cycle oil and heavy gasoline. Lighter materials from the main column enter a gas concentration section for further separation into additional product streams. Gas from an overhead receiver of the main column enters a gas concentration section. Typically gas from the main column receiver is compressed and combined with the bottoms stream from a primary absorber and gas from a stripper column. The combined stream enters a high pressure separator and gas from the separator is routed to a primary absorber where it is contacted with stabilized or unstabilized gasoline from the main column or the concentration section. An overhead from the primary absorber which is now deficient in $C_3$ and higher hydrocarbons enters a sponge absorber where it is contacted with a circulating stream of light cycle oil from the main column which is used as an absorption oil. The overhead or tail gas from the sponge absorber which consists mainly of ethane and lighter gas and includes hydrogen sulfide is directed to fuel gas treating. The sponge gas stream, after appropriate treating, is the preferred source of the lift gas stream for this invention. Any treatment method may be used that will reduce the $H_2S$ and overall sulfur concentration and the sponge gas to the levels hereinbefore described. In the preferred embodiment of this invention, the sponge gas stream will be amine treated to reduce the $H_2S$ and overall sulfur concentration before it is recycled back to the riser. The lift gas may also contain other light sulfur compounds such as COS. The amount of COS or other sulfur compounds in the lift gas must also be controlled in order to limit the overall sulfur concentration of the lift gas.

Another source of lift gas are off gas streams from other processes that have a low sulfur content. The sulfur concentration of suitable streams may be obtained by amide treatment or other processing for the removal of sulfur compounds.

What is claimed is:

1. A fluidized catalytic cracking (FCC) process for treating an FCC feedstock wherein said feedstock contains sulfur compounds, said process comprising;

(a) treating a lift gas source to remove sulfur compounds and recovering a lift gas stream having a concentration of sulfur and sulfur compounds of less than 50 ppm;

(b) contacting regenerated FCC catalyst with said lift gas stream in the upstream portion of a riser conversion zone;

(c) passing said mixture of catalyst and lift gas to a downstream section of said riser and contacting said mixture with an FCC feedstock having a sulfur concentration of at least 0.1 wt. % to crack hydrocarbons in said feedstock, convert said sulfur compounds to $H_2S$, and deposit coke on said catalyst;

(d) separating said cracked hydrocarbons and said $H_2S$ from said catalyst and recovering a cracked product stream comprising said cracked hydrocarbons and said $H_2S$;

(e) passing said catalyst containing coke deposits to a regeneration zone and contacting said catalyst in said regeneration zone with an oxygen containing gas at elevated temperature to regenerate said catalyst by the combustion of coke and to produce a flue gas containing the by-products of said coke combustion; and, (f) separating regenerated catalyst particles from said flue gas and passing said regenerated catalyst particles to said riser conversion zone as described in step (a).

2. The process of claim 1 wherein said feedstock comprises relatively heavy hydrocarbons having a concentration of sulfur compounds equal to at least 1.0 wt % of the feed.

3. The process of claim 1 wherein said light gas stream includes not more than 10 mol % $C_3$ and heavier hydrocarbons.

4. The process of claim 3 wherein said lift gas stream includes not more than 10 mol % $C_3$ and heavier hydrocarbons.

5. The process of claim 1 wherein said lift gas stream is obtained by amide treatment of an FCC sponge gas.

6. The process of claim 1 wherein said feedstream contacts said catalyst and said lift gas in said riser for at least 2 seconds.

7. The process of claim 1 wherein said lift gas comprises a portion of said cracked product stream.

8. A fluidized catalytic cracking (FCC) process for treating an FCC feedstock wherein said feedstock contains at least 0.1 wt. % sulfur compounds, said process comprising:

(a) contacting regenerated FCC catalyst with a lift gas in the upstream portion of a riser conversion zone, said lift gas having a sulfur and sulfur compound concentration of less than 50 ppm;

(b) passing said mixture of catalyst and lift gas to a downstream section of said riser and contacting said mixture with said feedstock to crack hydrocarbons in said feedstock, convert said sulfur compounds to $H_2S$, and deposit coke on said catalyst;

(c) separating said cracked hydrocarbons and said $H_2S$ from said catalyst and recovering a cracked product stream comprising said cracked hydrocarbons and said $H_2S$;

(d) separating said cracked hydrocarbons and said $H_2S$ to provide said lift gas stream;

(e) passing said catalyst containing coke deposits to a regeneration zone and contacting said catalyst in said regeneration zone with an oxygen containing gas at elevated temperature to regenerate said catalyst by the combustion of coke and to produce a flue gas containing the by-products of said coke combustion; and, (f) separating regenerated catalyst particles from said flue gas and passing said regenerated catalyst particles to said riser conversion zone as described in step (a).

9. The process of claim 8 wherein said feedstock comprises relatively heavy hydrocarbons having a concentration of sulfur compounds equal to at least 1.0 wt. % of the feed.

10. The process of claim 8 wherein said lift gas includes not more than 10 mol % $C_3$ and heavier hydrocarbons.

11. The process of claim 8 wherein said lift gas is obtained by amide treatment of an FCC sponge gas.

12. The process of claim 8 wherein said feedstream contacts said catalyst and said lift gas in said riser for at least 2 seconds.

13. The process of claim 8 wherein said lift gas is recovered in product recovery facilities including a main column and a gas concentration section.

* * * * *